US005105566A

United States Patent [19]

Legon

[11] Patent Number: 5,105,566

[45] Date of Patent: Apr. 21, 1992

[54] DEVICE FOR ADJUSTING THE POSITION OF A CONTROL COLUMN IN RELATION TO THE UPPER OF A SHOE

[75] Inventor: Fabrice Legon, Seynod, France

[73] Assignee: Salomon, S.A., Annecy Cedex, France

[21] Appl. No.: 759,721

[22] Filed: Aug. 22, 1991

Related U.S. Application Data

[63] Continuation of Ser. No. 588,557, Sep. 26, 1990, abandoned.

[30] Foreign Application Priority Data

Sep. 28, 1989 [FR] France ..... 89 12931

[51] Int. Cl.[5] ..... A43B 5/04

[52] U.S. Cl. ..... 36/121; 36/120; 36/118

[58] Field of Search ..... 36/117-121, 36/109, 50

[56] References Cited

U.S. PATENT DOCUMENTS 4,406,073 9/1983 Spademan ..... 36/119
4,561,196 12/1985 Petrini et al. ..... 36/118
4,685,226 8/1987 Olivieri et al. ..... 36/120
4,958,448 9/1990 Wenzel ..... 36/119

FOREIGN PATENT DOCUMENTS 0071055 2/1983 European Pat. Off. ..... 36/118
0123636 10/1984 European Pat. Off. ..... 36/120

*Primary Examiner*—Paul T. Sewell
*Assistant Examiner*—Thomas P. Hilliard
*Attorney, Agent, or Firm*—Sandler, Greenblum & Bernstein

[57] ABSTRACT

The control column is attached around a transverse axle on the upper of a shoe, preferably a sports shoe having a high upper. The axle pivoting in the control column has a cam pivoting in the upper. Complementary elements held by the control column and the upper cooperate to lock in position the control column in relation to the upper in a determined position of the cam and the opposite to free the control column to rotate to a position opposite the cam. The cam, axle ensemble can be manually rotated by the wearer of the shoe. Several successive locking positions allow a progressive adjustment of the control column for optimal support of the lower leg of the wearer of the shoe.

8 Claims, 3 Drawing Sheets

DEVICE FOR ADJUSTING THE POSITION OF A CONTROL COLUMN IN RELATION TO THE UPPER OF A SHOE

This application is a continuation of application Ser. No. 07/588,557, filed Sept. 26, 1990, now abandoned.

BACKGROUND OF THE INVENTION

1. Field of the Invention

The present invention relates to shoes with high uppers especially intended for sports, or of an orthopedic character, and whose upper has at least one relatively rigid part serving to hold and support the rear or front of the lower leg of the wearer. It concerns a control column that is an organ to distribute the pressure of the lower leg on the upper, and more particularly, a device to adjust the position of this control column in relation to the rest of the upper on which it is mounted.

2. Description of Background and Other Information

Among the shoes more precisely concerned by the invention are ski boots, and it is in reference to these that the invention will be described in particular, it being understood that any transposition, in the context of the invention, could be made for other types of shoes, especially for ice hockey or other sports, and for orthopedic shoes where the front or back support of the lower leg of the wearer is important.

For ski boots, the purely descriptive category which we have chosen, the problem of the importance of a comfortable and effective support for the lower leg of the skier is clearly described in the introduction to the description of French Patent No. 2,089,128, and it is thus not necessary to elaborate on considerations which are now well known by man of the art.

In the following, reference will be made to contemporary boots, with a rigid shell on which is attached a rigid upper around a transverse axis in a single piece, or as is also known, made of a forward collar and a rear cover, and on which is mounted, joined to the monolithic upper or to one of its respective parts, a support element for the lower leg, called a control column, because it is intended to distribute, in the front or back, the stress and contact pressure from wearing the boot itself and from its use, which can be particularly dynamic, and critical for the wearer. However, it must remain clear that in the context of the invention, the most important thing is the upper which includes at least one rigid upper front or rear part on which the control column is mounted. The rest of the construction of the boot is completely unconcerned in the concept of its lower part, particularly the base of the rigid shell and upper in one or two parts (collar and rear cover attached or not to the base of the shell.

In French Patent No. 2,089,128, a hook is provided, approximately equivalent to what we call the "control column", attached to a lever which is attached to the rear part of the boot upper. Outside of the double joint which renders construction of the device extremely complex, a cam pressing on the rear part of the collar adjusts the extreme angular position cf the hook in the rear direction. In this type of construction, the hook or control column follows the movement of the lower leg in the rear direction, supplying them with some delay or inertia because of the freedom of the articulation of the lever which holds it in relation to the rear part of the upper. Also, it should be noted that the device described, particularly because of its extreme bulkiness and not being integrated into the general shape of the boot, applies only as described to the rear part of the upper or a rear covering, and thus would not be transposable, even if only for construction and esthetic reasons, to a forward control column mounted on the front part of the upper or part of the collar.

European Patent Application No. 0,229,638 describes a control column device mounted on the rear part of the upper or the rear cover, or on the forward part of the upper or the collar, attempting to respond to the same concerns. The control column is attached to the collar or to the rear cover or the rear part of the upper. A latching device permits the adjustment of the position of the rear stop of the control column for rear lower leg supports, but nothing is in the way of an upward displacement of the control column. The adjustment point of the lower stop can change in an untimely manner during the maneuvers of the wearer, and manual intervention at rest is necessary to return to the original adjustment conditions.

The same document also describes the device where the incline of the control column can be positively adjusted in both directions by two link connection rods on the control column and to non-rotating nuts and engaged by to opposite threads which present a transverse upper controlled by a retractable lever. The lever is only retractable in one position, adjustment can be only be made by sudden changes in amplitude corresponding to a 360° rotation of the threaded upper.

Another solution proposed in the same document is to use, between the control column and the shoe upper, a parallelpiped stop tilting between two stable positions. No intermediary stable position between these two extremes is possible, and nothing is mentioned concerning control of the stop to pass from one extreme position to the other.

For the parallelpiped stop, as proposed, a cam can be substituted in the form of a wedge tilting between two extreme positions around an axis parallel to the general axis of the boot. Here again, no progressive adjustment between the two stable extreme positions is provided.

U.S. Pat. No. 4,203,235 which we note in passing, only applies to a rear control column device, apparently not transposable because of the complexity of construction to a front collar, where one tries to obtain an adjustment, not by separate sudden changes but by continuous changes in the position of the control column. This concept uses wedges inserted between the rear part of the boot upper and the control column and thus the relative position is adjustable. As already mentioned, this construction is extremely complex and can only be conceived for the rear of the boot upper.

SUMMARY OF THE INVENTION

The present invention aims to eliminate these drawbacks and/or insufficiencies described above in reference to the state of the art, by proposing a control column or distribution plate for supporting the lower leg attached to the front of the boot upper (collar) or the back of the boot (rear cover), whose inclination with respect to the upper is progressively adjustable and positively determined without the maneuvers of the wearer altering it, except, of course, by a voluntary manual intervention when stopped.

BRIEF DESCRIPTION OF THE DRAWINGS

The above and additional objects, characteristics, and advantages of the present invention will become apparent in the following detailed description of preferred embodiments, with reference to the accompanying drawings which are presented as non-limiting examples, in which.

DETAILED DESCRIPTION OF PREFERRED EMBODIMENTS

Figure 1:
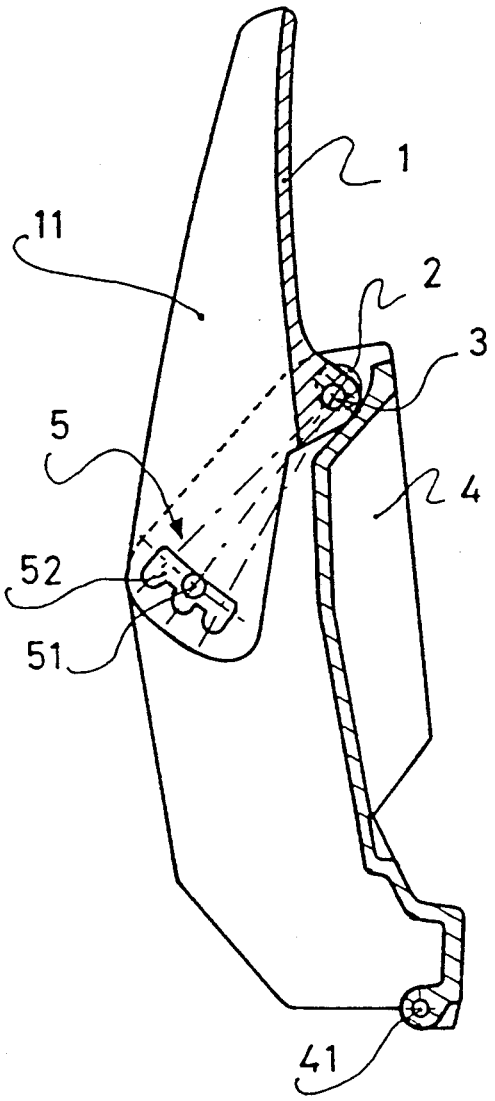
FIG. 1 shows a lengthwise section in relation to the shoe, an adjustment device for the control column according to the invention, attached to a rear cover in an unlocked position.
Figure 2:
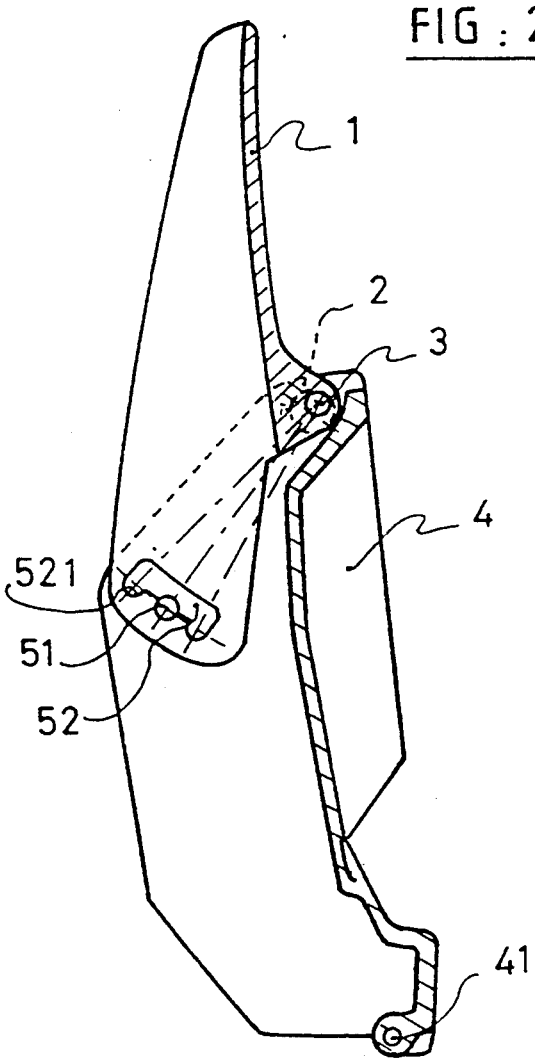
FIG. 2 shows the same device in the locked position after adjustment.

In FIGS. 1 and 2 a known rear cover 41 is shown attached to the shell of the boot (not shown). The rear cover could also easily be replaced by the rear part of the boot upper 4 without the corresponding arrangements being significantly modified. Also, to simplify the following description of the invention, the parts of the boot upper 4 provided on the device according to the invention will also be identified by reference 4. On the inside of the rear upper 4 is attached around a transverse axle 3 with respect to the shoe, a control column 1 intended to distribute the stress of supporting the lower leg and assure optimal comfort for the wearer. This axle 3 pivoting in the control column 1, holds a cam 2 pivoting in the rear cover 4 at the level of each of intersections of the axle 3 with the cover. The two cams are thus identical, with the same angular setting on axle 3. At least one of the two cams 2 holds an exterior means, for example, a raised button or a small retractable crank allowing it to be manually rotated.

When such a rotation occurs, the cams 2 move around their geometric axis with axle 3 in rotation, the effect cf which is to move the control column in a combined alternating translation and rotation movement with respect to the rear cover 4, like a cotter end. Except for a different arrangement, the control column 1 is also capable cf rotating around the articulation axis of axle 3, fixed in relation &o the rear cover 4 when the cams 2 are immobilized. This allows one to search for the optimal incline of the control column 1 in relation to the rear cover 4, thus in relation to the lower leg of the wearer. Having obtained this position, &.he control column 1 can be locked into place, and to modify this position if need be, to be able to unlock it. The device allowing this operation in cooperation with the axle 3-cam 2 ensemble mentioned above is now described.

The control column 1 has two lateral wings 11 hose lower part molds the interior shape of the rear cover 4. In this zone 11, the control column 1 and the rear cover 4 have on at least one side away from the axle 3-cam 2 ensemble, locking and unlocking means 5. As a nonlimiting example, such means appear in the unlocked position in FIG. 1 and locked position in FIG. 2.

As shown in the figures, the locking devices 5 are constituted by a pin 51 held by the internal side of the rear cover 4 and a hole 52 in the thickness of the wing 11 of the control column 1, and with which it cooperates. The pin is advantageously cylindrical and can occupy any transitory position inside the hole 52. The hole 52 generally has the shape of a circular ring concentric to axle 3. On the side of its smallest radius, that is the upper part, the edge of the hole 52 is effectively an arc of a circle. The side with the larger diameter, the (lower) edge of the hole 52 has successive regular half-circle depressions 521, with a diameter corresponding to that of pin 51.

The operation of these locking means is described below.

In the unlocked position in FIG. 1, the pin 51 is disengaged from any depression 521 and is free in the hole 52 until the extreme position where it stops against the upper edge of the hole 52, but remains free to slide the length of the hole. The axle 3 of the control column 1 is in its extreme position closest to pin 51 of a rear cover 4. The control column 1 is completely free to rotate around its axle 3, and is transitorily fixed in relation to the rear cover 4, obviously between the angular limits defined by the extreme edges of the hole. The control column 1 is placed in the chosen angular position with respect to the rear cover 4. This position achieved, the control column 1 should be positively immobilized. To do this, the cam 2 is subjected to half a rotation in one direction or the other, which brings the axle 3 of the control column 1 into its extreme position that is the farthest away from the pin 51 and moves the control column in the direction of the radius passing through pin 51. Pin 51 is then embedded in the corresponding depression 521, which thus prevents any relative angular displacement between the control column 1 and the rear cover 4 as long as the cam 2 is not moved again. The control column is then in the stable locked position as seen in FIG. 2. From this stable locked position, a new half rotation in one direction or the other of the cam 2 will completely unlock the device and free ,the control column in rotating in relation to the rear cover. The control column is then in the position illustrated in FIG. 1.

Figure 2A:
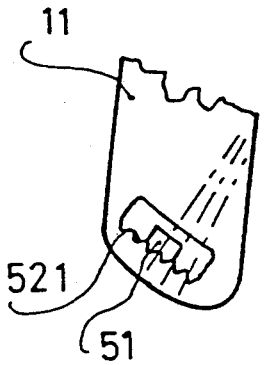
FIG. 2*a* shows the detail of a variation.

It is obviously within the scope of the invention to give the lower edge of the hole 52 and the pin 51 other complementary shapes. A variation is illustrated in FIG. 2*a*. In this case, pin 51 is in a parallelpiped shape, its lower side provided with grooves with a saw-tooth contour, and the lower edge of the hole 52 is also provided with grooves 521 with the same saw-tooth contour. The operation of the device is analogous to the proceeding, but the configuration permits a much finer angular adjustment of the control column 1 in relation to the rear cover 4.

What was just described in reference to a rear control column is directly transferable *mutatis mutandis* to a forward control column, that is, attached to a collar 4 on the upper rear part 4 of the boot upper 4.

Figure 3:
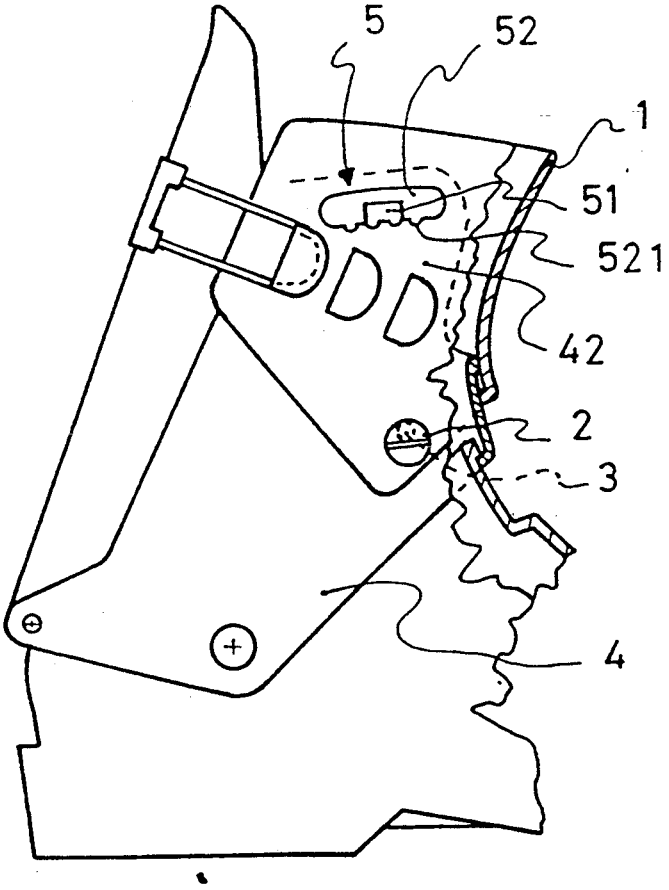
FIG. 3 illustrates an elevated view of a lengthwise section of another construction of the invention with the control column attached to a collar of the boot upper.

In an example of such, which does not need further explanation to be understood, is illustrated in FIG. 3. However, it should be noted that this control column 1 is mounted on the outside of the collar 4, which has at least one lateral ring 42 extending upward and holding the pin 51 since the locking means 5, for practical reasons, are found in this instance on the top part in relation to the axle 3-cam 2 ensemble. In addition, in the design, the edge r,f the hole 52 holding the hooking 521 is that which is closest to this axle 3-cam 2 ensemble, but as in the preceding case, the choice does not matter because it does not alter the operation of the ensemble of the device.

Figure 4:
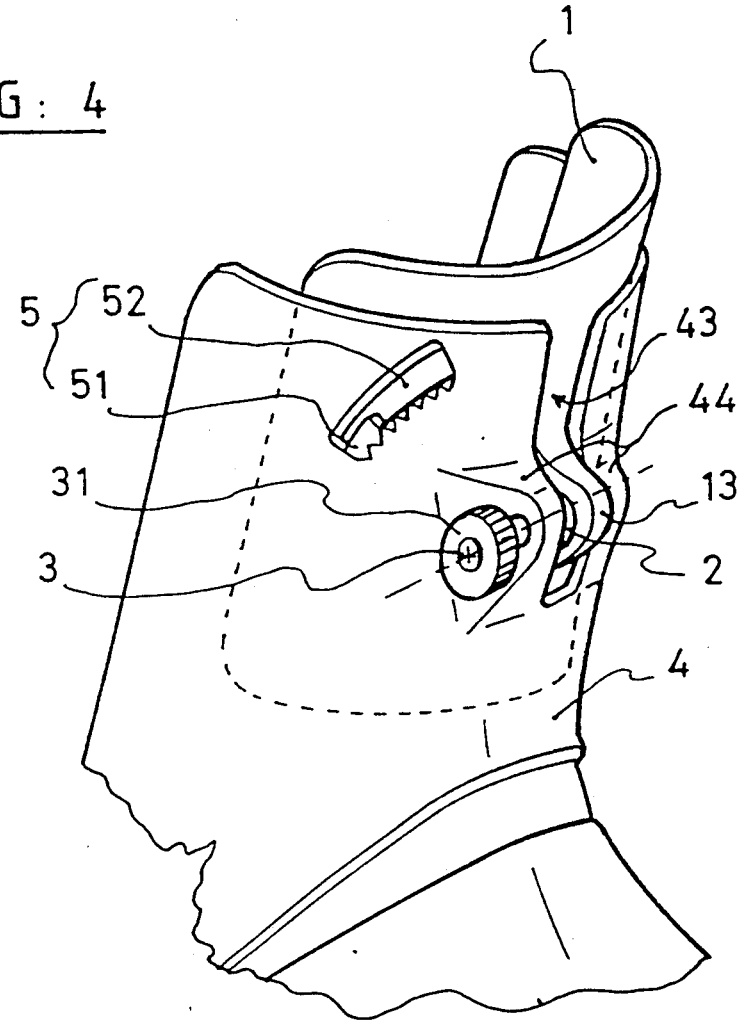
FIG. 4 shows another construction mode for the invention also with a control column attached to a collar, FIG. 4*a* showing a detail of the FIG. 4 embodiment.

Another example of the invention is illustrated in FIG. 4, which illustrates a front support control column 1 for the lower leg of the wearer. The control column 1 is joint mounted in rotation on the collar 4 of the boot, but this could also be on the upper part of an ordinary shoe upper.

Figure 4A:
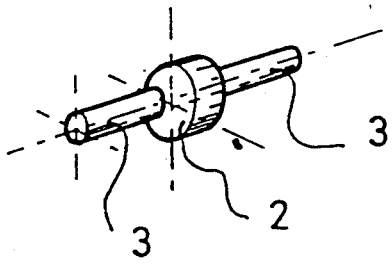

The collar 4 has, on its upper part and extending on either side of the median longitudinal vertical plane of the shoe, a slot bordered by two brackets 44 serving as a bearing for a transverse axle 3 which can be driven in rotation, for example, by means of a raised button 31. In its median zone corresponding to the slot 43, the axle 3 holds a cam 2. The axle 3 carrying the cam 2 is represented alone in perspective in FIG. 4a.

The control column 1 has in its front median part and extending on either side of the median longitudinal vertical plane of the boot, a bracket 13 of a thickness corresponding to the width of the slot 43 in which it lodges. In this bracket 13 of the control column 1, the cam 2 pivots. Away from the axle 3-cam 2 ensemble, in the upper zone of the control column 1 and the collar 4, are found locking and unlocking devices 5 for the relative angular position of the control column 1 and the collar 4. These devices 5 are similar to those that were described in the preceding construction examples of the invention and it is thus not necessary to elaborate on that configuration. The essential difference in the present case is the fact that &.he hole 52 in the ring segment is open here in the collar 4, and the pin 51 held by the control column 1. In this design, the complementary shapes permitting locking into position are here located on the side closest to the axle 3-cam 2 ensemble, but it does not matter for the operation of this device which is directly deduced from the preceding case, and it is not necessary to further describe it.

It should be noted in the present case that there is only a single cam, which can be analyzed as a simplification of the construction.

From the proceeding description of several construction modes for an adjustment device for the position of a control column in relation to the upper of a boot according to the invention, a person skilled in the art could, in the alternative case, without significant difficulty effect any useful modification according to the constructive constraints linked to a design and appropriate destination of the shoe which must be thus equipped.

Finally, although the invention has been described with reference of particular means, materials and embodiments, it is to be understood that the invention is not limited to the particulars disclosed and extends to all equivalents within the scope of the claims.

What is claimed is:

1. A device for adjusting the position of a control column with respect to an upper of a boot, said control column being pivotable about a transverse axis on said upper for supporting a lower leg of a user, said device comprising:

(a) at least one cam mounted for rotation about said transverse axis, a transverse axle mounted on said cam, said control column being pivotable about said transverse axle relative to said upper;

(b) complementary locking means being spaced from said transverse axle, said complementary locking means comprising first means and second means, one of said first and second means being positioned on said upper, the other of said first and second locking means being positioned on said control column, said first and second means being relatively movable to an engaged position to lock the position of said control column, said first and second means being relatively movable to a disengaged position to allow said control column to pivot freely about said transverse axle;

wherein manual rotation of said at least one cam causes transverse movement of said transverse axle and relative movement of said first and second means to and from said engaged position.

2. The device according to claim 1, comprising two cams located on respective sides of said upper.

3. The device according to claim 1, wherein said at least one cam comprises a cam pivoting in said control column, said axle extending on each side of said cam and pivoting in said upper.

4. The device according to claim 1, wherein said first means comprises a hole in one of said control column and said upper, said second means comprises a pin in the other of said control column and said upper, said pin being free to move in said hole when in said disengaged position to permit said control column to pivot with respect to said upper, said pin being immobilized against an edge of said hole when in said engaged position to prevent any pivoting of said control column with respect to said upper.

5. The device according to claim 4, wherein said hole is in the shape of a ring segment, said ring segment being concentric with said transverse axis, said edge of said hole having a configuration to allow said pin to be immobilized in a plurality of positions.

6. The device according to claim 3, wherein said pin is substantially cylindrical, and said edge of said hole includes a plurality of depressions, each depression having a diameter corresponding to the diameter of said pin.

7. The device according to claim 5, wherein said pin has a substantially parallelpiped shape, a side of said pin including grooves with a saw-tooth contour, said edge of said hole including a corresponding saw-tooth contour for engagement with said grooves.

8. The device according to claim 7, including means to permit manual rotation of said cam.

* * * * *